US010993045B1

(12) United States Patent
Thiemann et al.

(10) Patent No.: US 10,993,045 B1
(45) Date of Patent: Apr. 27, 2021

(54) HEARING DEVICES AND METHODS FOR IMPLEMENTING AUTOMATIC SENSOR-BASED ON/OFF CONTROL OF A HEARING DEVICE

(71) Applicant: SONOVA AG, Staefa (CH)

(72) Inventors: Joachim Thiemann, Hannover (DE); Anne Thielen, Stäfa (CH); Hans-Ueli Roeck, Hombrechtikon (CH); Julia Seiter, Stäfa (CH); Michael Eckardt, Stäfa (CH); Nadim El Guindi, Zürich (CH); Nina Stumpf, Maennedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/834,476

(22) Filed: Mar. 30, 2020

(51) Int. Cl.
*H04R 25/00* (2006.01)

(52) U.S. Cl.
CPC ..... *H04R 25/30* (2013.01); *H04R 2225/61* (2013.01); *H04R 2460/03* (2013.01)

(58) Field of Classification Search
CPC ..... H04R 25/602; H04R 2225/31; H04R 2225/33
USPC ..... 381/323
See application file for complete search history.

(56) References Cited

U.S. PATENT DOCUMENTS

| | | | | |
|---|---|---|---|---|
| 8,027,497 | B2 * | 9/2011 | Klemenz | H04R 25/55 381/323 |
| 8,462,972 | B2 * | 6/2013 | Hastrup | H04R 25/607 381/323 |
| 8,958,590 | B2 * | 2/2015 | Hastrup | H04R 25/607 381/323 |
| 8,971,554 | B2 | 3/2015 | Van Halteren et al. | |
| 9,078,070 | B2 | 7/2015 | Samuels | |
| 2013/0195295 | A1 | 8/2013 | Van Halteren et al. | |
| 2017/0164120 | A1 | 6/2017 | Johansen et al. | |
| 2018/0077502 | A1 | 3/2018 | Pedersen et al. | |

FOREIGN PATENT DOCUMENTS

| | | |
|---|---|---|
| EP | 2888890 | 3/2017 |
| EP | 3264798 | 1/2018 |

* cited by examiner

*Primary Examiner* — Suhan Ni
(74) *Attorney, Agent, or Firm* — ALG Intellectual Property, LLC

(57) ABSTRACT

An exemplary hearing device includes a first sensor, a second sensor, an audio processing component, and a power management processor. The power management processor may be configured to determine, while the hearing device is in a first low power mode, that the first sensor detects a first state change associated with the hearing device, direct, based on the first sensor detecting the first state change, the hearing device to enter a second low power mode in which the second sensor is active and the audio processing component is inactive, determine, while the hearing device is in the second low power mode, that the second sensor detects a second state change associated with the hearing device, and direct, based on the second sensor detecting the second state change, the hearing device to enter a full power mode in which the audio processing component is active.

20 Claims, 7 Drawing Sheets

HEARING DEVICES AND METHODS FOR IMPLEMENTING AUTOMATIC SENSOR-BASED ON/OFF CONTROL OF A HEARING DEVICE

BACKGROUND INFORMATION

Hearing devices (e.g., hearing aids) are used to improve the hearing capability and/or communication capability of users. Such hearing devices are configured to process a received input sound signal (e.g., ambient sound) and then provide the processed input sound signal to the user (e.g., by way of a receiver (e.g., a speaker) placed in the user's ear canal or at any other suitable location).

Hearing devices are typically provided with rechargeable batteries used to power the hearing devices to represent processed input sound signals to users. With such hearing devices, power management is a particularly difficult issue because users often fail to appropriately switch on/off their hearing devices. For example, a user may manually turn on a hearing device after removing the hearing device from a charging station. However, the user may forget to turn off or return the hearing device to the charging station, which results in drain on the rechargeable battery of the hearing device.

To prevent such a result, hearing devices may be provided with one or more sensors configured to detect information that may be used to determine when to turn hearing devices on or off. For example, a hearing device may be configured to turn on when an acceleration sensor of the hearing device detects movement and turn off when no movement has been detected for some predetermined period of time. However, a hearing device configured in such a manner may be triggered to unnecessarily turn on in instances when the hearing device is not in use. For example, a user of the hearing device may remove the hearing device from the user's head (e.g., by removing the hearing device from being inserted within the user's ear canal) and place the hearing device in his/her pocket. While the hearing device is in the user's pocket, the acceleration sensor of the hearing device may detect movement caused by the user walking or moving in any manner and cause the hearing device to turn on. This undesirably results in increased power consumption and reduced battery life of the rechargeable battery as the hearing device unnecessarily cycles through an on/off procedure while not being used by the user.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
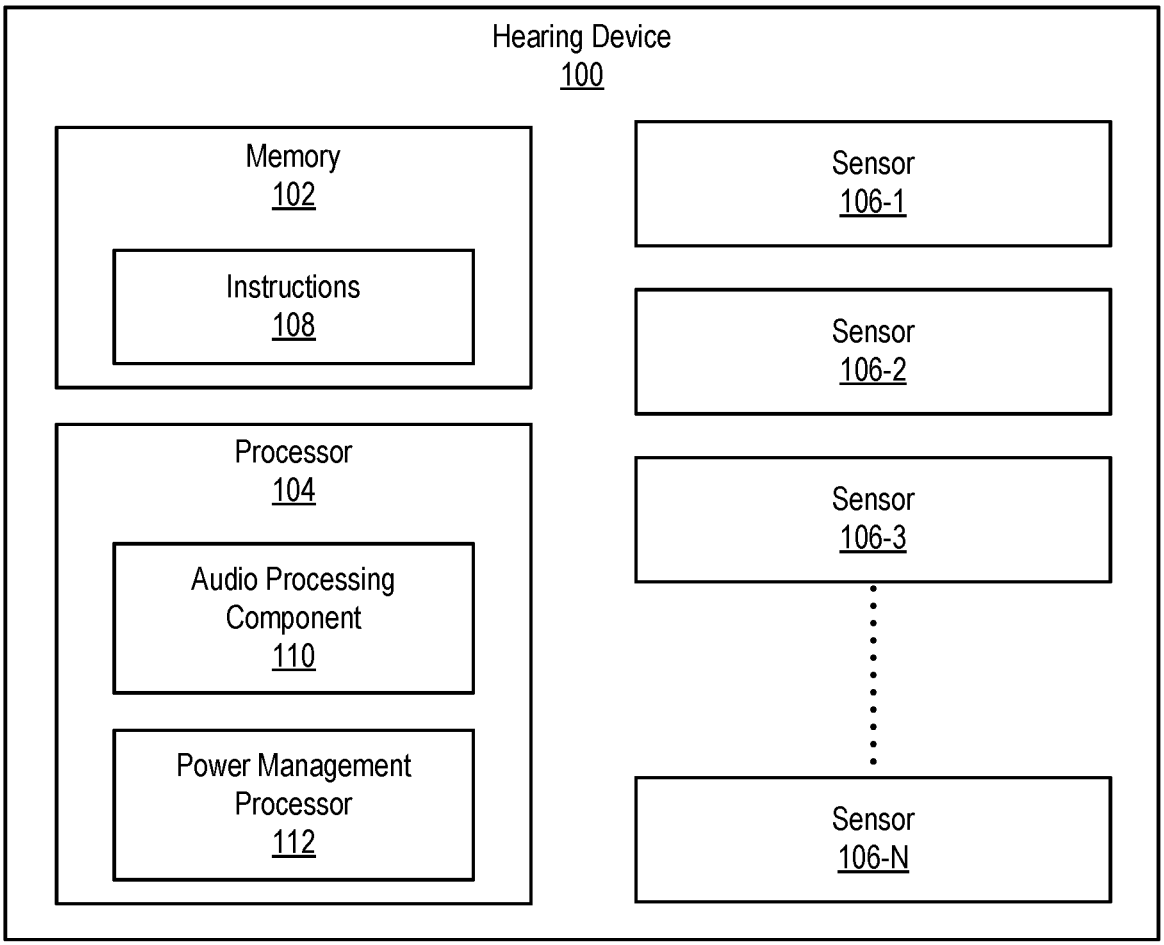
FIG. 1 illustrates an exemplary hearing device according to principles described herein.

Hearing devices and methods for implementing automatic sensor-based ON/OFF control of a hearing device are described herein. As will be described in more detail below, an exemplary hearing device comprises a first sensor, a second sensor, an audio processing component, and a power management processor communicatively coupled to the first sensor, the second sensor, and the audio processing component. The power management processor may be configured to determine, while the hearing device is in a first low power mode in which the first sensor is active and the second sensor and the audio processing component are inactive, that the first sensor detects a first state change associated with the hearing device, direct, based on the first sensor detecting the first state change, the hearing device to enter a second low power mode in which the second sensor is active and the audio processing component is inactive, determine, while the hearing device is in the second low power mode, that the second sensor detects a second state change associated with the hearing device, and direct, based on the second sensor detecting the second state change, the hearing device to enter a full power mode in which the audio processing component is active.

By providing hearing devices and methods such as those described herein, it is possible to progressively activate sensors of a hearing device in a step-wise manner to ensure, prior to the hearing device automatically entering a full power mode, that the hearing device is currently worn by the user (e.g., is inserted within the user's ear canal). In this manner, the hearing devices and methods described herein may reduce average power consumption thereby extending the time needed between charges, allow for use of a relatively smaller rechargeable battery, and/or reduce the number charge cycles and thereby extend the battery life of the rechargeable battery of the hearing device. Other benefits of the hearing devices and methods described herein will be made apparent herein.

As used herein, a "hearing device" may be implemented by any device configured to provide or enhance hearing to a user. For example, a hearing device may be implemented by a hearing aid configured to amplify audio content to a user, a sound processor included in a cochlear implant system configured to apply electrical stimulation representative of audio content to a user, a sound processor included in a stimulation system configured to apply electrical and acoustic stimulation to a user, or any other suitable hearing prosthesis or combination of hearing prostheses. In some examples, a hearing device may be implemented by a behind-the-ear ("BTE") component configured to be worn behind an ear of a user. In some examples, a hearing device may be implemented by an in-the-ear ("ITE") component configured to at least partially be inserted within an ear canal of a user. In some examples, a hearing device may include a combination of an ITE component, a BTE component, and/or any other suitable component.

FIG. 1 illustrates an exemplary hearing device 100 that may be implemented according to principles described herein. As shown, hearing device 100 may include, without limitation, a memory 102, a processor 104, and sensors 106 (e.g., sensors 106-1 through 106-N) selectively and communicatively coupled to one another. Memory 102 and processor 104 may each include or be implemented by hardware and/or software components (e.g., processors, memories, communication interfaces, instructions stored in memory for execution by the processors, etc.). In some examples, memory 102 and processor 104 may be distributed between multiple devices (e.g., multiple computing devices) and/or multiple locations as may serve a particular implementation.

Memory 102 may maintain (e.g., store) executable data used by processor 104 to perform any of the operations associated with implementing automatic sensor-based ON/OFF control of a hearing device. For example, memory 102 may store instructions 108 that may be executed by processor 104 to perform any of the operations associated with hearing device 100 described herein. Instructions 108 may be implemented by any suitable application, software, code, and/or other executable data instance.

Memory 102 may also maintain any data received, generated, managed, used, and/or transmitted by processor 104. For example, memory 102 may maintain any data suitable to facilitate communications (e.g., wired and/or wireless communications) between hearing device 100 and one or more additional computing devices, such as those described herein. Memory 102 may maintain additional or alternative data in other implementations.

Processor 104 is configured to perform any suitable processing operation that may be associated with hearing device 100. As shown in FIG. 1, processor 104 may include an audio processing component 110 and a power management processor 112 communicatively coupled to one another. Although audio processing component 110 and power management processor 112 are shown as being part of processor 104 in FIG. 1, it is understood that audio processing component 110 and power management processor 112 may be implemented as separate, stand-alone processors in certain implementations.

Audio processing component 110 is configured to perform any suitable processing operation associated with representing audio content to a user of hearing device 100. For example, when hearing device 100 corresponds to a hearing aid device, such processing operations may include monitoring ambient sound and/or representing sound to a user via an in-ear receiver. In examples where hearing device 100 is included as part of a cochlear implant system, such processing operations may include directing a cochlear implant to generate and apply electrical stimulation representative of one or more audio signals (e.g., one or more audio signals detected by a microphone, input by way of an auxiliary audio input port, etc.) to one or more stimulation sites associated with an auditory pathway (e.g., the auditory nerve) of a user.

Power management processor 112 is configured to perform any suitable operation associated with power management of hearing device 100. For example, power management processor 112 may be configured to perform (e.g., execute instructions 108 stored in memory 102 to perform) various processing operations associated with implementing automatic sensor-based ON/OFF control of hearing device 100. Such processing operations may include incrementally activating sensors 106 to facilitate determining whether hearing device 100 is currently being worn by a user. For example, power management processor 112 may determine, while hearing device 100 is in a first low power mode in which the first sensor (e.g., sensor 106-1) is active and the second sensor (e.g., sensor 106-2) and audio processing component 110 are inactive, that the first sensor detects a first state change associated with hearing device 100, direct, based on the first sensor detecting the first state change, hearing device 100 to enter a second low power mode in which the second sensor is active and audio processing component 110 is inactive, determine, while hearing device 100 is in the second low power mode, that the second sensor detects a second state change associated with the hearing device, and direct, based on the second sensor detecting the second state change, hearing device 100 to enter a full power mode in which audio processing component 110 is active. These and other operations that may be performed by hearing device 100 are described herein.

Sensors 106 may include any suitable sensor that may be used to measure or otherwise detect information that may be used to determine whether hearing device 100 is currently being worn by a user. For example, sensors 106 may include, but are not limited to, a motion sensor (e.g., an accelerometer), a temperature sensor, a humidity sensor, a proximity to tissue sensor, a light sensor, and/or any other suitable sensor or combination of sensors. In certain examples, each of sensors 106 may be configured to detect or measure a single characteristic that may be used to determine whether hearing device 100 is currently being worn by a user. For example, sensor 106-1 may be configured to detect or measure a first characteristic, sensor 106-1 may be configured to detect or measure a second characteristic, sensor 106-2 may be configured to detect or measure a third characteristic, etc. To illustrate, in certain implementations, sensor 106-1 may only be configured to detect motion, sensor 106-2 may only be configured to detect temperature, and sensor 106-3 may only be configured to detect pressure. In certain alternative implementations, one or more of sensors 106 may be configured to detect or measure a combination of characteristics that may be used to determine whether hearing device 100 is currently being worn by a user. For example, sensor 106-1 may be configured to detect or measure both motion and orientation of hearing device 100 and sensor 106-2 may be configured to detect or measure both temperature and pressure. Hearing device 100 may have any suitable number of sensors 106 as may serve a particular implementation. In certain alternative implementations, one or more of sensors 106 may be separate from but communicatively coupled to hearing device 100.

Hearing device 100 is configured to leverage sensors 106 in any suitable manner to determine when to automatically enter a full power mode (e.g., an ON state). As used herein, a "full power mode" refers to a mode in which operating power is supplied to audio processing component 110 so that hearing device 100 may represent audio content to a user. It is understood that audio processing component 110 is configured to not be able to operate in any mode other than the full power mode.

To reduce power consumption, it is desirable that hearing device 100 only enter the full power mode while hearing device 100 is currently worn by a user (e.g., while inserted within an ear canal of the user). Accordingly, hearing device 100 (e.g., power management processor 112 of processor 104) may be configured to automatically enter a plurality of different low power modes to determine whether hearing device 100 is currently being worn by the user. As used herein, the expression "automatically" means that an operation (e.g., entering a full power mode) or series of operations are performed without requiring further input from a user. For example, as will be described herein, hearing device 100 may be configured to automatically and progressively enter a plurality of different low power modes prior to hearing device 100 automatically entering a full power mode.

Figure 2:
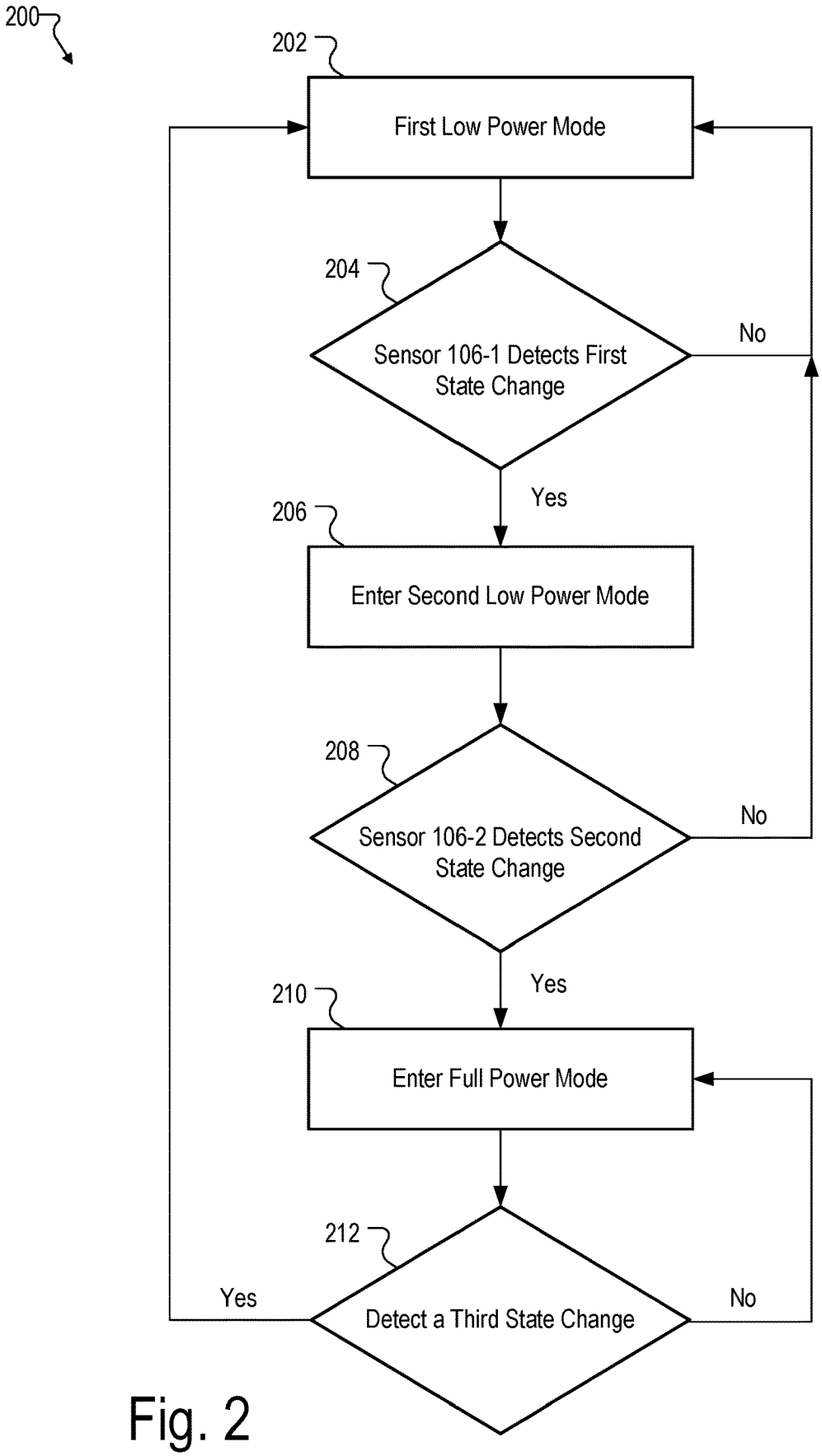
FIG. 2 illustrates an exemplary flowchart showing operations that may be performed by the hearing device of FIG. 1 according to principles described herein.

To illustrate, FIG. 2 shows an exemplary flowchart 200 that depicts operations that may be performed by hearing device 100 according to principles described herein. As shown in FIG. 2, hearing device 100 may initially be in a first low power mode in operation 202. During the first low power mode, sensor 106-1 may be active and sensor 106-2 and audio processing component 110 may be inactive. Sensor 106-1 may be considered as active in the first low power mode because sensor 106-1 is capable of detecting a first state change associated with hearing device 100 while in the first low power mode. Sensor 106-2 and audio processing component 110 may be considered as inactive during the first low power mode because they are not capable of operating while hearing device 100 is in the first low power mode. In certain examples, sensor 106-2 and audio processing component 110 may be inactive due to either a negligible amount or no operating power may be provided to them. As such, in the first low power mode, not enough operating power may be provided to sensor 106-2 to detect information and not enough operating power may be provided to audio processing component 110 to represent audio content to a user. In certain examples, each sensor 106 of hearing device 100 other than sensor 106-1 may be inactive during the first low power mode.

Hearing device 100 may activate sensor 106-1 in any suitable manner. For example, while hearing device 100 is in the first low power mode, hearing device 100 may provide at least some operating power to sensor 106-1 to activate sensor 106-1. Such operating power may be provided in any suitable manner. For example, hearing device 100 may continually provide operating power to sensor 106-1 while hearing device 100 is in the first low power mode. Alternatively, hearing device 100 may periodically provide operating power to sensor 106-1 while hearing device 100 is in the first low power mode.

In certain examples, hearing device 100 may activate sensor 106-1 by periodically querying sensor 106-1 for information. For example, hearing device 100 may query sensor 106-1 in predetermined time intervals (e.g., using a relatively lower clock rate to further reduce power consumption) for information. In certain alternatively examples, hearing device 100 may receive information from sensor 106-1 instantly without the need for periodically querying sensor 106-1 (e.g., through passive circuit bandpass filtering).

In certain examples, while hearing device 100 is in the first low power mode, hearing device 100 may be configured to enter a rest mode whenever hearing device 100 is not querying sensor 106-1 for information. Additionally or alternatively, in certain examples, hearing device 100 may not query any sensor 106 other than sensor 106-1 while hearing device 100 is in the first low power mode.

In operation 204, hearing device 100 may determine whether sensor 106-1 has detected a first state change associated with hearing device 100. The first state change may be represented by any information detected by sensor 106-1 that may indicate whether hearing device 100 is worn by a user. For example, if sensor 106-1 corresponds to a motion sensor (e.g., an accelerometer), hearing device 100 may determine that the first state change has occurred when an amount of motion detected by sensor 106-1 is above some predefined threshold. Alternatively, if sensor 106-1 corresponds to a temperature sensor, hearing device 100 may determine that the first state change has occurred when the temperature detected by sensor 106-1 is within some predefined range of a normal body temperature of a user. Alternatively, if sensor 106-1 corresponds to a pressure sensor, hearing device 100 may determine that the first state change has occurred when an amount of pressure detected by sensor 106-1 is above some predefined threshold. Alternatively, if sensor 106-1 is configured to detect or measure two or more characteristics (e.g., both motion and orientation, both pressure and temperature, etc.), hearing device 100 may determine that the first state change has occurred based on one or more of the two or more characteristics. For example, hearing device 100 may determine that the first state change has occurred when both an amount of motion detected by sensor 106-1 is above some predefined threshold and an orientation of hearing device 100 detected by sensor 106-1 indicates that hearing device 100 is being worn by a user.

As shown in FIG. 2, if the answer in operation 204 is "No," hearing device 100 remains in the first low power mode. However, if the answer in operation 204 is "Yes," hearing device 100 may enter a second low power mode in operation 206. While hearing device 100 is in the second low power mode, sensor 106-2 is active and audio processing component 110 is inactive. In certain examples, sensor 106-1 may be active in addition to sensor 106-2 while hearing device 100 is in the second low power mode. Accordingly, in certain examples, hearing device 100 may use relatively more operating power in the second low power mode than in the first low power mode.

While hearing device 100 is in the second low power mode, hearing device 100 may determine whether sensor 106-2 has detected a second state change associated with hearing device 100 in operation 208. The second state change may be represented by any information detected by sensor 106-2 that may indicate whether hearing device 100 is worn by a user. Hearing device 100 may determine whether the second state changed has occurred in any suitable manner, such as described herein. In certain examples, the second state change may be of a different type than the first state change. For example, sensor 106-1 may be a motion sensor and the first state change may be associated with movement detected by motion sensor. On the other hand, sensor 106-2 may be a light sensor and the second state change may be associated with an amount of light detected by the light sensor. In such an example, hearing device 100 may determine that the second state change has occurred when the amount of detected light is less than a predefined amount (e.g., due to being inserted within an ear canal of the user), which may indicate that hearing device 100 is being worn by the user.

As shown in FIG. 2, if the answer in operation 208 is "No," hearing device 100 may enter the first low power mode. However, if the answer in operation 208 is "Yes," hearing device 100 may enter a full power mode based on the determinations that sensor 106-1 detected the first state change and sensor 106-2 detected the second state change. During the full power mode, audio processing component 110 is active. As such, while hearing device 100 is in the full power mode, audio processing component 110 is configured to process audio content received by hearing device 100 and render the audio content to a user of hearing device 100. Accordingly, while in the full power mode, hearing device 100 may be considered to be in an ON state.

In certain examples, a first subset of sensors 106 may be active and a second subset of sensors 106 may be inactive while hearing device 100 is in the full power mode. For example, while hearing device 100 is in the full power mode, sensor 106-1 and sensor 106-2 may be active but sensor 106-3 may be inactive. In certain alternative examples, while hearing device 100 is in the full power mode, each of sensors 106 included as part of hearing device 100 may be active so as to detect information associated with whether hearing device 100 is currently being worn by the user.

While hearing device 100 is in the full power mode, one or more of sensors 106 may detect information indicating that hearing device 100 is no longer worn by the user (e.g., as a result of being removed from the user's ear canal). In certain examples, such information may be indicative of a third state change associated with hearing device 100. Accordingly, in operation 212, hearing device 100 may determine whether a third state change has been detected. Hearing device 100 may determine whether the third state change has occurred in any suitable manner. For example, hearing device may use any one or a combination of sensors 106 to determine whether the third state change has been detected. In certain implementations, hearing device 100 may determine whether the third state change has been detected by using only one sensor included in sensors 106. To illustrate, sensor 106-3 may correspond to a temperature sensor. While hearing device 100 is in the full power mode, hearing device 100 may query sensor 106-3 for a temperature reading. Based on the temperature reading, hearing device 100 may determine that the detected temperature is outside of a predetermined temperature range associated with a normal body temperature of a user. Such a reading may be indicative of hearing device 100 being removed from the ear of the user. Accordingly, in response to such a temperature reading, hearing device 100 may determine that the answer to operation 212 is "Yes," and may enter the first power mode, as shown in FIG. 2. Alternatively, hearing device 100 may determine that there has not been a third state change because that the temperature reading from sensor 106-3 is within the predetermined temperature range. Accordingly, in such an instance, hearing device may determine that the answer to operation 212 is "No," and remain in the full power mode.

In certain alternative examples, hearing device 100 may determine that there has been a third state change by querying one or more additional sensors 106 to confirm information associated with the third state change. In so doing, it may be possible to avoid instances in which one of sensors 106 detects an erroneous measurement that appears to indicate that hearing device 100 is not currently being worn. In certain examples, such a confirmation may include querying each of sensors 106 of hearing device 100 to confirm information associated with the third state change. To illustrate, sensor 106-1 may correspond to a humidity sensor, sensor 106-2 may correspond to a pressure sensor, and sensor 106-3 may correspond to a temperature sensor. After hearing device 100 determines that sensor 106-3 detects a temperature during the full power mode that may indicate that hearing device is no longer worn by the user, hearing device 100 may query sensor 106-1 for a humidity reading and sensor 106-2 for a pressure reading. If the humidity reading the pressure reading each indicate that hearing device 100 is currently being worn by the user, hearing device may remain in the full power mode. Alternatively, if the humidity reading and the pressure reading each confirm that hearing device 100 has been removed from the user's head, hearing device 100 may enter the first low power mode.

Although flowchart 200 shown in FIG. 2 only shows the first low power mode and the second low power mode, it is understood that hearing device 100 may incrementally step through any suitable number of low power modes prior to entering the full power mode as may serve a particular implementation. To illustrate, in certain examples, in response to operation 208, hearing device 100 may, based on sensor 106-2 detecting the second state change, enter a third low power mode in which sensor 106-3 is active and audio processing component 110 is inactive. In certain examples, sensor 106-3 may be the only sensor active during the third low power mode. Alternatively, each of sensors 106-1, 106-2, and 106-3 may be active during the third low power mode. In addition, while in the third low power mode, power consumption by hearing device 100 may be more than in the first low power mode and the second low power mode, but less than in the full power mode.

While hearing device 100 is in the third low power mode, hearing device 100 may determine whether the sensor 106-3 detects a third state change associated with hearing device. In such an example, the third state change may be associated with further information indicated that hearing device 100 is currently being worn by the user. For example, sensor 106-3 may correspond to a humidity sensor. While hearing device 100 is in the third low power mode, sensor 106-3 may detect a humidity level above some predefined threshold which may indicate, for example, that hearing device 100 has been inserted within an ear canal of the user. Based on the detected humidity level, hearing device 100 may determine that the third state change has occurred and may enter the full power mode. On the other hand, if hearing device 100 determines that sensor 106-3 did not detect the third state change, hearing device 100 may enter the first low power mode. Accordingly, in such implementations, hearing device 100 may enter the full power mode based on the determinations that sensor 106-1 detected the first state change, sensor 106-2 detected the second state change, and sensor 106-3 detected the third state change.

Hearing device 100 may repeat such operations any suitable number of times depending on how many sensors 106 are included as part of hearing device 100. For example, hearing device 100 may be further configured to automatically enter a fourth low power mode, a fifth low power mode, a six low power mode, etc. prior to automatically entering the full power mode in certain implementations.

Figure 3:
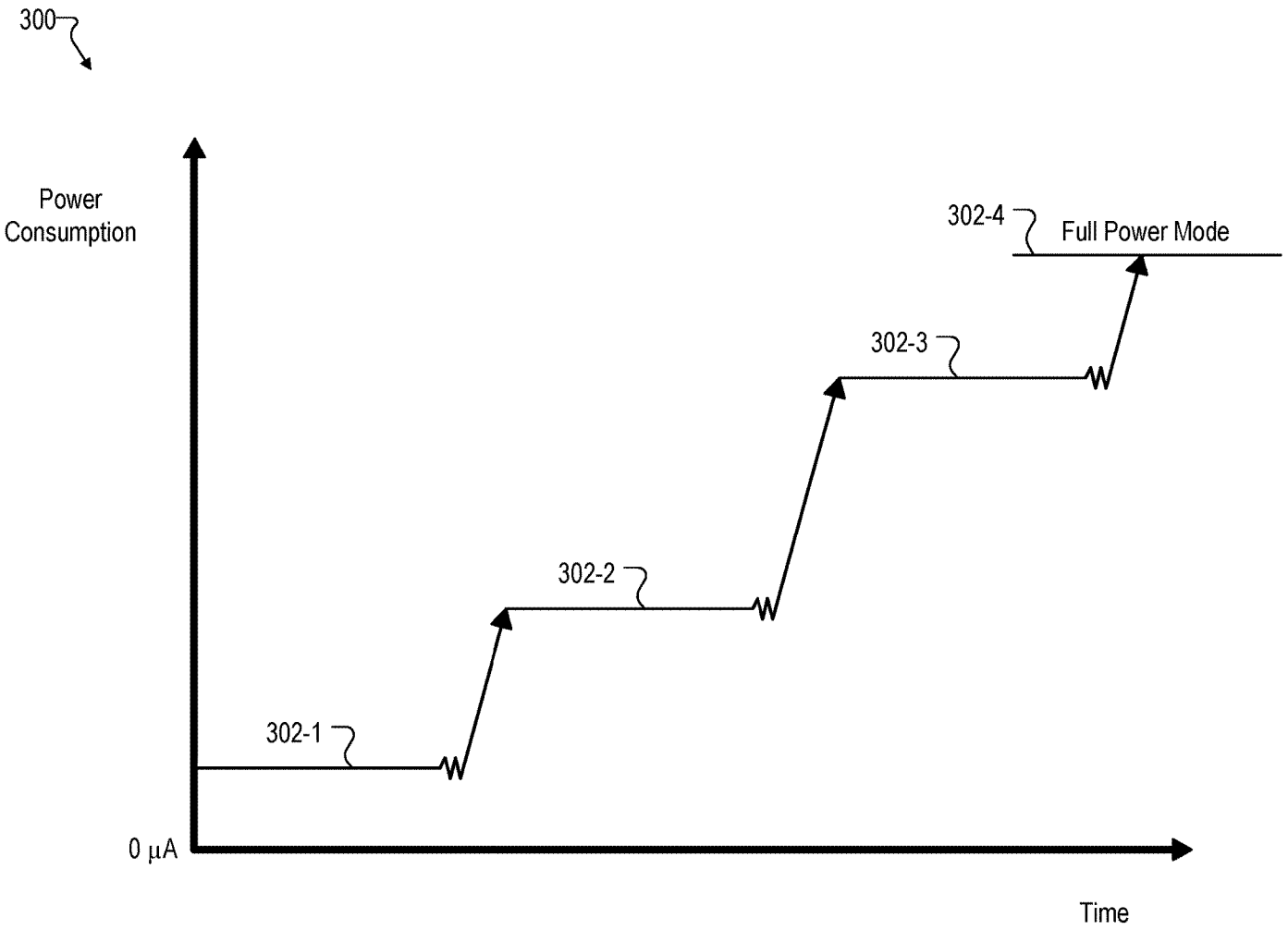
FIG. 3 illustrates an exemplary graph showing incremental increases in power consumption that may be implemented according to principles described herein.

Hearing device 100 may determine which type of sensor to progressively activate first based on any suitable criteria that may facilitate reducing power consumption of hearing device 100. In certain examples, the first sensor to be activated (e.g., sensor 106-1) according to principles such as those described herein may be of a type that uses relatively less operating power than others of sensors 106. The second sensor to be activated (e.g., sensor 106-2) may use relatively more operating power than the first sensor and so forth. To illustrate, FIG. 3 shows an exemplary graph 300 that depicts relative power consumption requirements of various sensors as a function of time as hearing device 100 progressively steps through a plurality of low power modes. As shown in FIG. 3, power consumption level 302-1 may correspond to the amount of operating power needed to activate sensor 106-1, the increase from power consumption level 302-1 to power consumption level 302-2 may correspond to the amount of operating power needed to activate sensor 106-2, the increase from power consumption level 302-2 to power consumption level 302-3 may correspond to the amount of operating power needed to activate sensor 106-3. The amount of operating power indicated by power consumption level 302-1 may correspond to the amount of power used during a first low power mode. The total amount of operating power indicated by power consumption level 302-2 may correspond to the amount of power used during the second low power mode. The total amount of operating power indicated by power consumption level 302-3 may correspond to the amount of power used during the third low power mode. Power consumption level 302-4 may correspond to the total amount of operating power required to operate hearing device 100 in the full power mode (e.g., to operate audio processing component 110 and each of sensors 106). In the example shown in FIG. 3, the amount of operating power required to activate sensor 106-1 is relatively less than the amount of power required to activate sensor 106-2. By using a more power efficient sensor as the first sensor to be activated, hearing device 100 may be configured to conserve power and increase battery life of a rechargeable battery associated with hearing device 100. In certain examples, hearing device 100 may use a motion sensor (e.g., an accelerometer) as the first sensor to be activated due to the relatively low power requirements of such a motion sensor as compared to other types of sensors.

Additionally or alternatively, hearing device 100 may determine which type of sensor to progressively activate first based on a measurement confidence level associated with the various types of sensors. A measurement confidence level refers to the likelihood that a given measurement will accurately indicate that hearing device 100 is currently worn by a user. In certain examples, the measurement confidence level may be larger for each subsequent sensor that is activated. For example, the first sensor to be activated (e.g., sensor 106-1) may have a first measurement confidence level, the second sensor to be activated (e.g., sensor 106-2) may have a second measurement confidence level, and the third sensor to be activated (e.g., sensor 106-3) may have a third measurement confidence level, etc. In such examples, the second measurement confidence level may be relatively higher than the first measurement confidence level, and the third measurement confidence level may be relatively higher than the second measurement confidence level.

Figure 4:
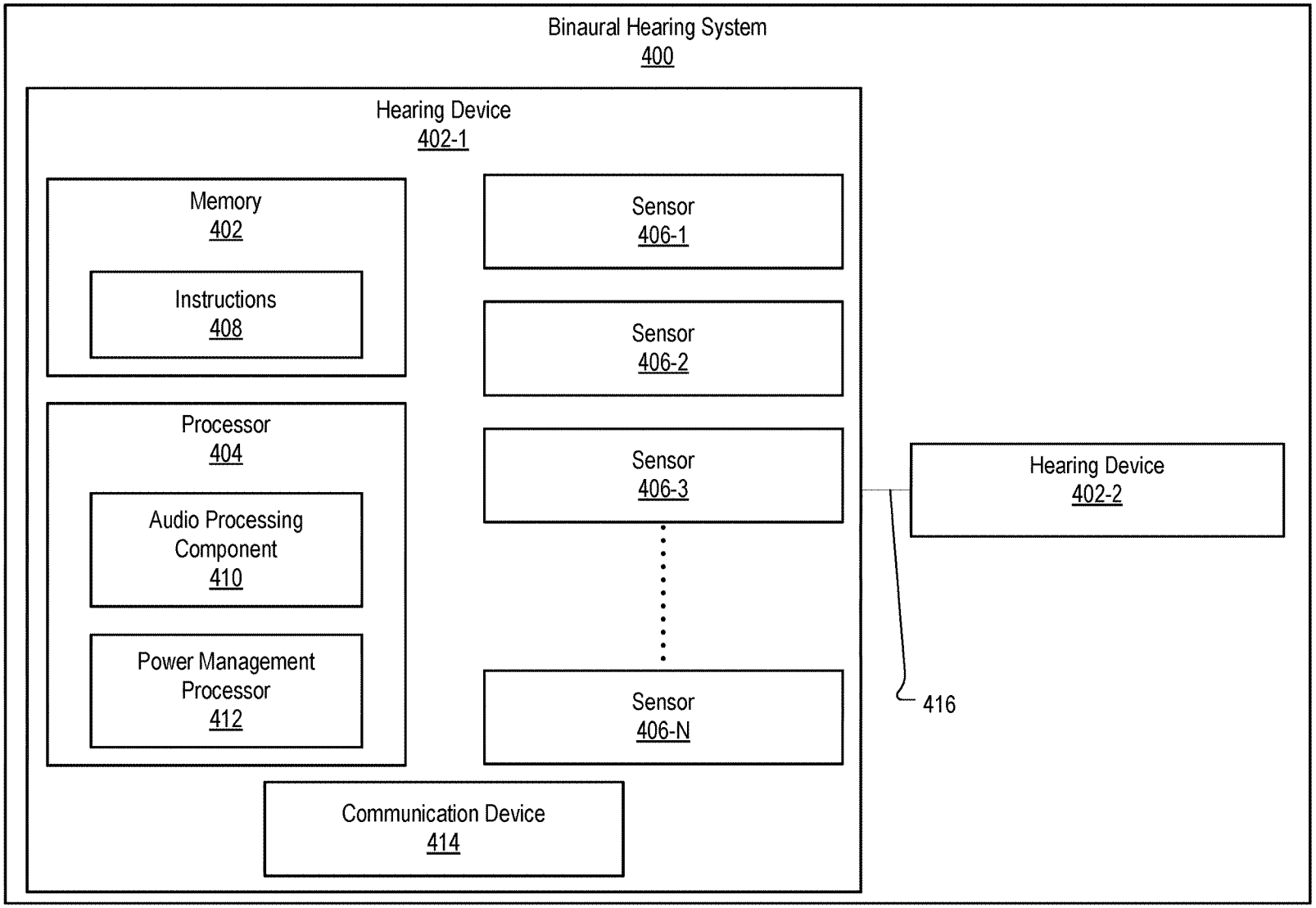
FIG. 4 illustrates an exemplary binaural hearing system that may be implemented according to principles described herein.

In certain examples, hearing devices such as those described herein may be implemented as part of a binaural hearing system. As such, FIG. 4 illustrates an exemplary binaural hearing system 400 that includes a first hearing device 402-1 and a second hearing device 402-2 (collectively "hearing devices 402"). In certain examples, hearing devices 402 may have a side specific structure because they are each configured to fit with respect to a particular ear of a user. For example, first hearing device 402-1 may be configured to only fit within an ear canal of a left ear of a user and second hearing device 402-2 may be configured to only fit within an ear canal of a right ear of the user. Alternatively, first hearing device 402-1 and second hearing device 402-2 may each fit within either ear canal of user. Each element shown in binaural hearing system 400 will now be described in detail.

As shown, hearing device 402-1 may include, without limitation, a memory 402, a processor 404, sensors 406 (e.g., sensors 406-1 through 406-N), and communication device 414 selectively and communicatively coupled to one another. Memory 402 and processor 104 may each include or be implemented by hardware and/or software components (e.g., processors, memories, communication interfaces, instructions stored in memory for execution by the processors, etc.). In some examples, memory 402 and processor 404 may be distributed between multiple devices (e.g., multiple computing devices) and/or multiple locations as may serve a particular implementation.

Memory 402 may maintain (e.g., store) executable data used by processor 404 to perform any of the operations associated with implementing automatic sensor-based ON/OFF control of hearing device 402-1. For example, memory 402 may store instructions 408 that may be executed by processor 404 to perform any of the operations associated with hearing device 402-1 described herein. Instructions 408 may be implemented by any suitable application, software, code, and/or other executable data instance.

Memory 402 may also maintain any data received, generated, managed, used, and/or transmitted by processor 404. For example, memory 402 may maintain any data suitable to facilitate communications (e.g., wired and/or wireless communications) between hearing device 402-1 and one or more additional computing devices, such as those described herein. Memory 402 may maintain additional or alternative data in other implementations.

Processor 404 is configured to perform any suitable processing operation that may be associated with hearing device 402-1. As shown in FIG. 4, processor 404 may include an audio processing component 410 and a power management processor 412 communicatively coupled to one another. Processor 404, audio processing component 410, power management processor 412, and sensors 406 may be configured to operate in a manner similar to that described above with respect to processor 104, audio processing component 110, power management processor 112, and sensors 106 of hearing device 100. Accordingly, certain details associated with their operation are not repeated here. However, unlike hearing device 100, hearing device 400 includes communication device 414 that is configured to maintain a binaural communication link 416 that interconnects hearing devices 402.

Although not shown in FIG. 4, hearing device 402-2 may be configured in a manner similar to hearing device 402-2. That is, hearing device 402-2 may include a memory, processor, a plurality of sensors, a communication device, etc. that are configured to operate in any suitable manner, such as described herein.

Conventional binaural hearing systems typically require binaural wearing of hearing devices (e.g., hearing aids) to function properly. As such, an undetected removal of one hearing device in a conventional binaural hearing system may lead to undesirable artefacts or even signal loss. Unlike conventional binaural systems, binaural system 400 may be configured to function properly even when one of hearing devices 402 is removed from being worn by the user and subsequently automatically turned off according to principles described herein. For example, hearing device 402-1 may remain in a full power mode regardless of whether hearing device 402-2 is currently being worn by the user. In such instances, how hearing device 402-1 may operate while in the full power mode may change once hearing device 402-2 is removed. For example, while both hearing devices 402 are worn by a user, stereo audio content may be represented to the user by way of hearing devices 402. When hearing device 402-2 is removed from being worn by the user, the stereo audio content provided by way of hearing devices 402 may change to mono audio content provided by way of hearing device 402-1. Additionally or alternatively, hearing devices 402 may be configured to perform a stereo beamformer function to facilitate hearing by a user. When, for example, hearing device 402-2 is removed from the head of the user, binaural system 400 may instruct hearing device 402-1 to operate in accordance with a monaural beamformer function. Additionally or alternatively, hearing devices 402 may be configured to sever binaural communication link 416 when one of hearing devices 402 is removed from being worn by the user. Accordingly, it may be possible to conserve power that hearing devices 402 would have otherwise wasted trying to maintain binaural communication link 416.

Figure 5:
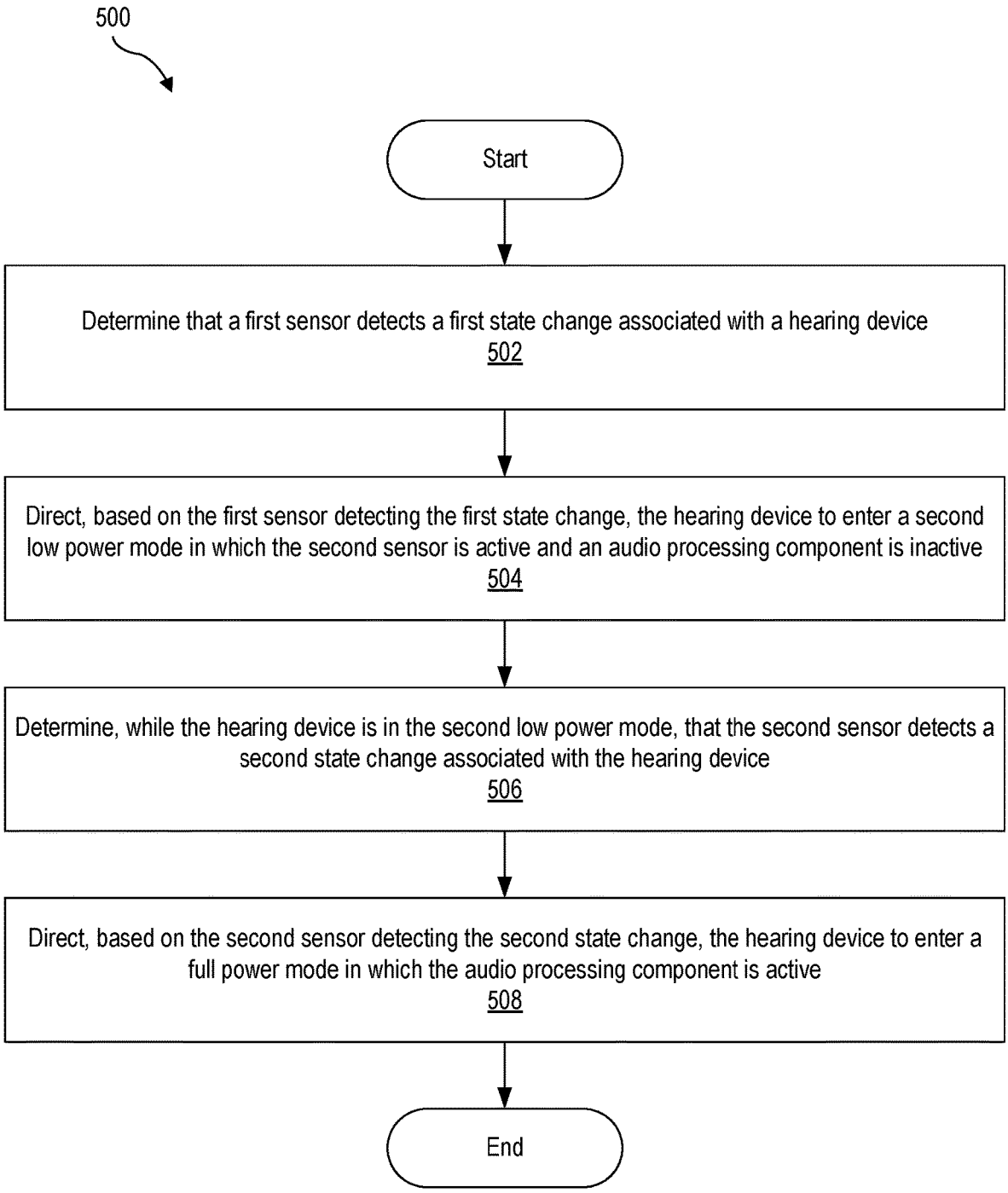
FIG. 5 illustrates an exemplary method for implementing automatic sensor-based ON/OFF control of a hearing device according to principles described herein.

FIG. 5 illustrates an exemplary method for implementing automatic sensor-based ON/OFF control of a hearing device. While FIG. 5 illustrates exemplary operations according to one embodiment, other embodiments may omit, add to, reorder, and/or modify any of the operations shown in FIG. 5. One or more of the operations shown in FIG. 5 may be performed by a hearing device such as hearing device 100, any components included therein, and/or any implementation thereof.

In operation 502, a processor (e.g., power management processor 112 of processor 104) may determine, while a hearing device (e.g., hearing device 100) is in a first low power mode in which a first sensor of the hearing device is active and a second sensor of the hearing device and an audio processing component of the hearing device are inactive, that the first sensor detects a first state change associated with the hearing device. Operation 502 may be performed in any of the ways described herein.

In operation 504, the processor may detect, based on the first sensor detecting the first state change, the hearing device to enter a second low power mode in which the second sensor is active and the audio processing component is inactive. Operation 504 may be performed in any of the ways described herein.

In operation 506, the processor may determine, while the hearing device is in the second low power mode, that the second sensor detects a second state change associated with the hearing device. Operation 506 may be performed in any of the ways described herein.

In operation 508, the processor may direct, based on the second sensor detecting the second state change, the hearing device to enter a full power mode in which the audio processing component is active. Operation 508 may be performed in any of the ways described herein.

In certain examples, a hearing device (e.g., processor 104, processor 404, etc.) may be configured to automatically enter a full power mode by using a single sensor (e.g., one of sensors 106, one of sensors 406, etc.) and a two-step boot process. During such a two-step boot process, measuring capabilities of the single sensor may be progressively activated to reduce power consumption. For example, the sensor may be initially activated to detect a first parameter that requires a relatively low amount of operating power to detect. If the single sensor detects that the first parameter satisfies some predefined requirement (e.g., is above some predefined threshold), the single sensor may be automatically set at a first boot level that activates the single sensor to detect second parameter that requires a relatively higher amount of operating power to detect than the first parameter. Based on information associated with the second parameter, the single sensor may be set to a second boot level, which may cause the hearing device to automatically enter a full power mode.

Figure 6:
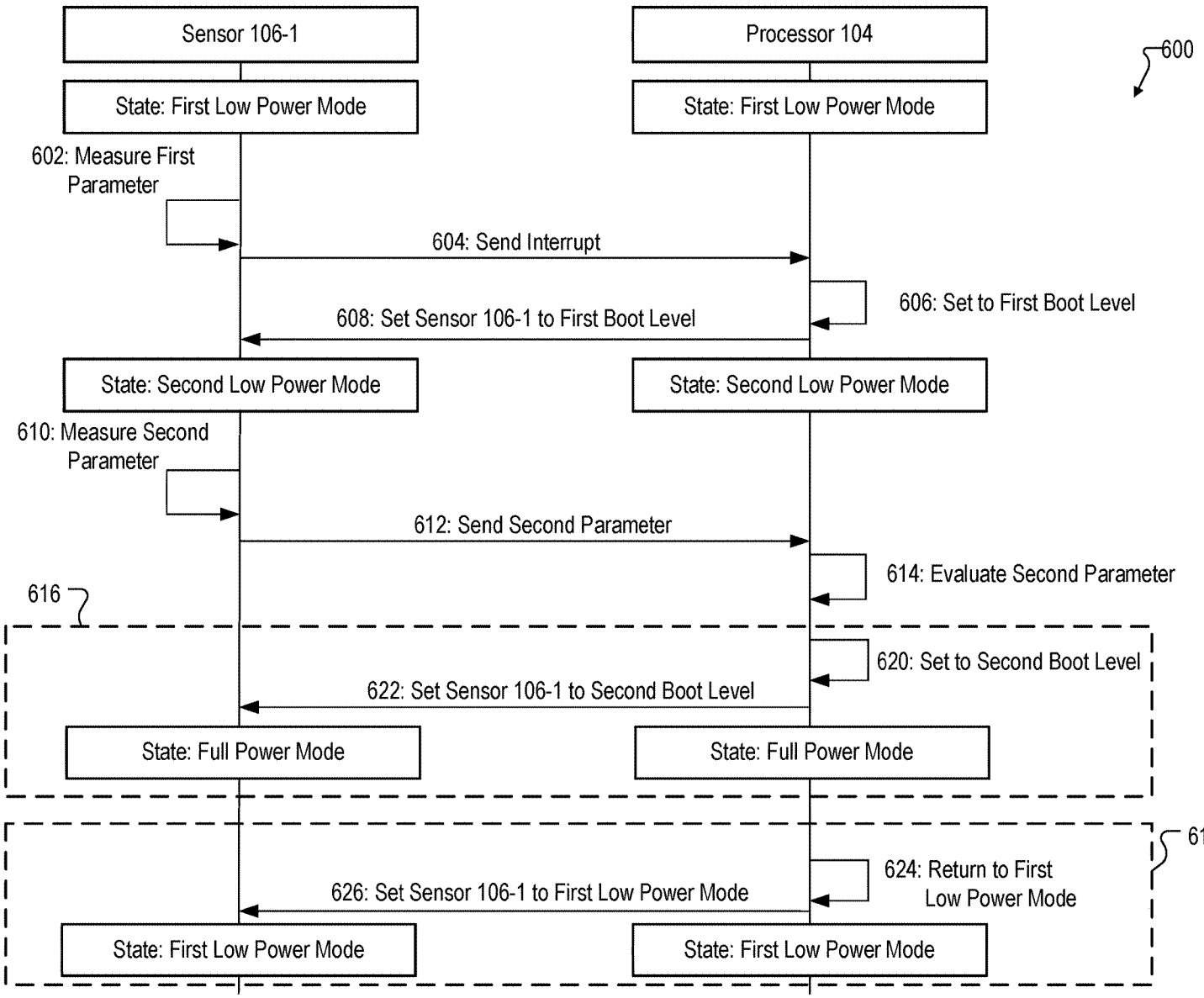
FIG. 6 illustrates another exemplary flowchart showing operations that may be performed by, for example, the hearing device of FIG. 1 according to principles described herein.

To illustrate, FIG. 6 shows a flowchart 600 that includes exemplary operations that may be performed by hearing device 100 in such implementations. As shown in FIG. 6, sensor 106-1 and processor 104 of hearing device 100 may each initially be in a first low power mode in which sensor 106-1 and processor 104 are configured to operate in what may be referred to as a "deep sleep" state. In operation 602, sensor 106-1 may measure a first parameter. For example, if sensor 106-1 is an accelerometer, sensor may detect whether motion experienced by hearing device 100 is above a predefined threshold. If the first parameter is above a predefined threshold, sensor 106-1 may send an interrupt to processor 104 in operation 604. In response to the interrupt, processor 104 may be set to a first boot level in operation 606. In addition, processor 104 may send a command to sensor 106-1 to be set to the first boot level in operation 608. In response to being set to the first boot level, each of sensor 106-1 and processor 104 enter a second low power state.

The first boot level activates sensor 106-1 to be able to measure a second parameter associated with hearing device 100. Accordingly, while in the second low power state, sensor 106-1 may measure the second parameter associated with hearing device 100 in operation 610. For example, if sensor 106-1 is a motion sensor, sensor 106-1 may be activated (e.g., have sufficient operating power) to measure acceleration in three axes while set to the first boot level.

In operation 612, sensor 106-1 may send the second parameter to processor 104. In operation 614, processor 104 evaluates the second parameter to determine whether the second parameter satisfies a predefined requirement associated with hearing device 100. For example, the predefined requirement may be associated with determining whether hearing device 100 is in a default wearing position based on the measured acceleration in three axes. This may be accomplished in any suitable manner. For example, processor 104 may compare x, y, and z acceleration data to gravity or any suitable default or calibrated position to determine whether hearing device 100 is in the default wearing position.

The operations associated with dashed-line boxes 616 and 618 may alternatively be performed depending on the result of operation 614. For example, if processor 104 determines in operation 614 that the second parameter indicates that hearing device 100 is currently worn by the user, the operations in box 616 may be performed. That is, processor 104 may be set to the second boot level in operation 620. In operation 622, processor 104 may send a command to set sensor 106-1 to the second boot level. While set to the second boot level, processor 104 and sensor 106-1 are configured to operate in a full power mode.

Alternatively, if processor determines in operation 614 that the second parameter indicates that hearing device is not worn by the user, operations associated with box 618 may be performed. That is, processor 104 may return to the first low power mode in operation 624. In addition, processor 104 may send a command to sensor 106-1 to return to the first low power mode in operation 626.

In some examples, a non-transitory computer-readable medium storing computer-readable instructions may be provided in accordance with the principles described herein. The instructions, when executed by a processor of a computing device, may direct the processor and/or computing device to perform one or more operations, including one or more of the operations described herein. Such instructions may be stored and/or transmitted using any of a variety of known computer-readable media.

A non-transitory computer-readable medium as referred to herein may include any non-transitory storage medium that participates in providing data (e.g., instructions) that may be read and/or executed by a computing device (e.g., by a processor of a computing device). For example, a non-transitory computer-readable medium may include, but is not limited to, any combination of non-volatile storage media and/or volatile storage media. Exemplary non-volatile storage media include, but are not limited to, read-only memory, flash memory, a solid-state drive, a magnetic storage device (e.g. a hard disk, a floppy disk, magnetic tape, etc.), ferroelectric random-access memory ("RAM"), and an optical disc (e.g., a compact disc, a digital video disc, a Blu-ray disc, etc.). Exemplary volatile storage media include, but are not limited to, RAM (e.g., dynamic RAM).

Figure 7:
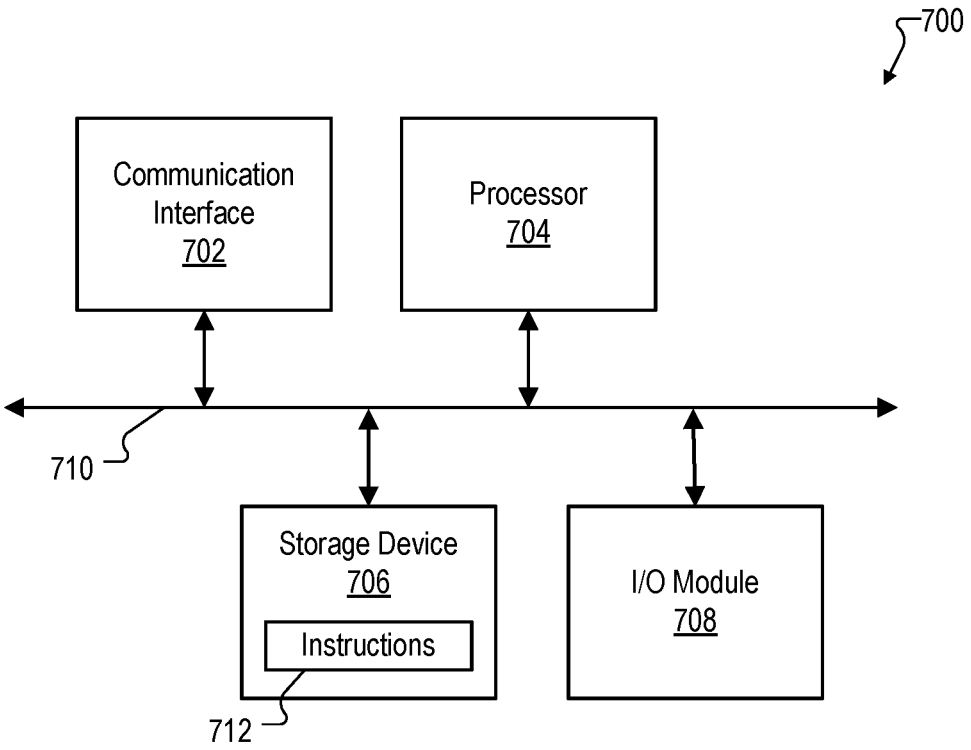
FIG. 7 illustrates an exemplary computing device according to principles described herein.

FIG. 7 illustrates an exemplary computing device 700 that may be specifically configured to perform one or more of the processes described herein. As shown in FIG. 7, computing device 700 may include a communication interface 702, a processor 704, a storage device 706, and an input/output ("I/O") module 708 communicatively connected one to another via a communication infrastructure 710. While an exemplary computing device 700 is shown in FIG. 7, the components illustrated in FIG. 7 are not intended to be limiting. Additional or alternative components may be used in other embodiments. Components of computing device 700 shown in FIG. 7 will now be described in additional detail.

Communication interface 702 may be configured to communicate with one or more computing devices. Examples of communication interface 702 include, without limitation, a wired network interface (such as a network interface card), a wireless network interface (such as a wireless network interface card), a modem, an audio/video connection, and any other suitable interface.

Processor 704 generally represents any type or form of processing unit capable of processing data and/or interpreting, executing, and/or directing execution of one or more of the instructions, processes, and/or operations described herein. Processor 704 may perform operations by executing computer-executable instructions 712 (e.g., an application, software, code, and/or other executable data instance) stored in storage device 706.

Storage device 706 may include one or more data storage media, devices, or configurations and may employ any type, form, and combination of data storage media and/or device. For example, storage device 706 may include, but is not limited to, any combination of the non-volatile media and/or volatile media described herein. Electronic data, including data described herein, may be temporarily and/or permanently stored in storage device 706. For example, data representative of computer-executable instructions 712 configured to direct processor 704 to perform any of the operations described herein may be stored within storage device 706. In some examples, data may be arranged in one or more databases residing within storage device 706.

I/O module 708 may include one or more I/O modules configured to receive user input and provide user output. I/O module 708 may include any hardware, firmware, software, or combination thereof supportive of input and output capabilities. For example, I/O module 708 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 708 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 708 is configured to provide graphical data to a display for presentation to a user. The graphical data may be representative of one or more graphical user interfaces and/or any other graphical content as may serve a particular implementation.

In some examples, any of the systems, hearing devices, and/or other components described herein may be implemented by computing device 700. For example, memory 102 or memory 402 may be implemented by storage device 706, and processor 104 or processor 404 may be implemented by processor 704.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A hearing device comprising:

a first sensor;

a second sensor;

an audio processing component; and a power management processor communicatively coupled to the first sensor, the second sensor, and the audio processing component, the power management processor configured to:

determine, while the hearing device is in a first low power mode in which the first sensor is active and the second sensor and the audio processing component are inactive, that the first sensor detects a first state change associated with the hearing device;

direct, based on the first sensor detecting the first state change, the hearing device to enter a second low power mode in which the second sensor is active and the audio processing component is inactive;

determine, while the hearing device is in the second low power mode, that the second sensor detects a second state change associated with the hearing device; and direct, based on the second sensor detecting the second state change, the hearing device to enter a full power mode in which the audio processing component is active.

2. The hearing device of claim 1, wherein the determining that the first sensor detects the first state change includes the power management processor querying the first sensor for information.

3. The hearing device of claim 2, wherein the power management processor is configured to periodically query the first sensor for the information while the hearing device is in the first low power mode.

4. The hearing device of claim 2, wherein the power management processor does not query any other sensor of the hearing device other than the first sensor while the hearing device is in the first low power mode.

5. The hearing device of claim 2, wherein, while the hearing device is in the first low power mode, the power management processor enters a rest mode whenever the power management processor is not querying the first sensor for the information.

6. The hearing device of claim 1, wherein the directing of the hearing device to enter the second low power mode includes the power management processor providing operating power to activate the second sensor.

7. The hearing device of claim 1, wherein, while the hearing device is in the second low power mode, both the first sensor and the second sensor are active.

8. The hearing device of claim 1, wherein, while the hearing device is in the full power mode, both the first sensor and the second sensor are active.

9. The hearing device of claim 1, wherein, while the hearing device is in the full power mode, the audio processing component is configured to process audio received by the hearing device and render the audio to a user of the hearing device.

10. The hearing device of claim 1, further comprising a third sensor communicatively coupled to the power management processor, wherein:

the power management processor is further configured to:

direct, based on the second sensor detecting the second state change, the hearing device to enter a third low power mode in which the third sensor is active and the audio processing component is inactive; and determine, while the hearing device is in the third low power mode, that the third sensor detects a third state change associated with the hearing device; and the directing of the hearing device to enter the full power mode is based on the third sensor detecting the third state change and the second sensor detecting the second state change.

11. The hearing device of claim 1, wherein:

while the hearing device is in the first low power mode, the first sensor is activated to detect a first parameter associated with the hearing device;

the determining that the first sensor detects the first state change includes:

determining that measurement of the first parameter by the first sensor satisfies a predefined condition;

setting, in response the determining that the measurement of the first parameter satisfies the predefined condition, the first sensor to a first boot level in which the first sensor is further activated to measure a second parameter associated with the hearing device, the second parameter requiring more operating power to measure than the first parameter and causing the hearing device to enter an additional low power mode;

determining, while the hearing device is in the additional low power mode, that measurement of the second parameter by the first sensor satisfies an additional predefined condition; and setting, in response the determining that the measurement of the second parameter satisfies the additional predefined condition, the first sensor to a second boot level; and the directing of the hearing device to enter the full power mode is further based on the setting of the first sensor to the second boot level.

12. The hearing device of claim 1, wherein the power management processor is further configured to:

determine, while the hearing device is in the full power mode, that there has been a third state change associated with the hearing device; and direct, based on the detecting of the third state change, the hearing device to enter the first low power mode in which the first sensor is active and the second sensor and the audio processing component are inactive.

13. The hearing device of claim 12, wherein the determining that there has been the third state change includes querying each of the sensors of the hearing device to confirm information associated with the third state change.

14. The hearing device of claim 1, wherein the first sensor has a first measurement confidence level and the second sensor has a second measurement confidence level that is higher than the first measurement confidence level.

15. The hearing device of claim 1, wherein:

the hearing device includes an in-the-ear component configured to be worn at least partially in an ear canal of a user of the hearing device; and the power management processor is configured to direct the hearing device to enter the full power mode only when the in-the-ear component is determined to be within the ear canal of the user.

16. The hearing device of claim 1, further comprising a communication device configured to establish a binaural communication link with an additional hearing device, wherein:

the hearing device is configured to be worn in relation to a first ear of a user; and the additional hearing device is configured to be worn in relation to a second ear of the user.

17. The hearing device of claim 16, wherein the power management processor is configured to direct the hearing device to enter the full power mode regardless of whether the additional hearing device is currently being worn in relation to the second ear of the user.

18. A method comprising:

determining, by a power management processor while a hearing device is in a first low power mode in which a first sensor of the hearing device is active and a second sensor of the hearing device and an audio processing component of the hearing device are inactive, that the first sensor detects a first state change associated with the hearing device;

directing, by the power management processor based on the first sensor detecting the first state change, the hearing device to enter a second low power mode in which the second sensor is active and the audio processing component is inactive;

determining, by the power management processor while the hearing device is in the second low power mode, that the second sensor detects a second state change associated with the hearing device; and directing, by the power management processor based on the second sensor detecting the second state change, the hearing device to enter a full power mode in which the audio processing component is active.

19. The method of claim 18, further comprising:

determining, by the power management processor while the hearing device is in the full power mode, that there has been a third state change associated with the hearing device; and directing, by the power management processor based on the detecting of the third state change, the hearing device to enter the first low power mode in which the first sensor is active and the second sensor and the audio processing component are inactive.

20. A non-transitory computer readable storage medium storing instructions that, when executed, direct a power management processor to:

determine, while a hearing device is in a first low power mode in which a first sensor of the hearing device is active and a second sensor of the hearing device and an audio processing component of the hearing device are inactive, that the first sensor detects a first state change associated with the hearing device;

direct, based on the first sensor detecting the first state change, the hearing device to enter a second low power mode in which the second sensor is active and the audio processing component is inactive;

determine, while the hearing device is in the second low power mode, that the second sensor detects a second state change associated with the hearing device; and direct, based on the second sensor detecting the second state change, the hearing device to enter a full power mode in which the audio processing component is active.

* * * * *